US009842538B2

(12) United States Patent
Lee et al.

(10) Patent No.: US 9,842,538 B2
(45) Date of Patent: Dec. 12, 2017

(54) ORGANIC LIGHT EMITTING DISPLAY DEVICE AND METHOD FOR DRIVING THE SAME

(71) Applicant: SAMSUNG DISPLAY CO., LTD., Yongin, Gyeonggi-Do (KR)

(72) Inventors: Won-Jun Lee, Yongin (KR); In-Soo Wang, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 365 days.

(21) Appl. No.: 14/534,060

(22) Filed: Nov. 5, 2014

(65) Prior Publication Data

US 2015/0123557 A1 May 7, 2015

(30) Foreign Application Priority Data

Nov. 6, 2013 (KR) ..... 10-2013-0134024

(51) Int. Cl.
*G09G 3/30* (2006.01)
*G09G 3/3233* (2016.01)

(52) U.S. Cl.
CPC ... *G09G 3/3233* (2013.01); *G09G 2300/0852* (2013.01); *G09G 2300/0861* (2013.01); *G09G 2310/06* (2013.01); *G09G 2320/045* (2013.01)

(58) Field of Classification Search
CPC ..... G09G 3/3233; G09G 3/3208
(Continued)

(56) References Cited

U.S. PATENT DOCUMENTS 8,058,808 B2 11/2011 Hong et al.
8,284,124 B2 10/2012 Kim et al.
(Continued)

FOREIGN PATENT DOCUMENTS

JP 2011-107441 6/2011
JP 5224702 3/2013

OTHER PUBLICATIONS

Patent Abstracts of Japan Publication No. 2007-279701, dated Oct. 25, 2007, for JP 5224702, 1 page.
(Continued)

*Primary Examiner* — Calvin C Ma
(74) *Attorney, Agent, or Firm* — Lewis Roca Rothgerber Christie LLP

(57) ABSTRACT

An organic light emitting display device includes a display panel including data lines, scan lines, initialization lines, and a plurality of pixels, wherein a pixel of the pixels includes: a driving transistor including a gate electrode coupled to a first node, a first electrode coupled to a second node, and a second electrode coupled to a third node, the driving transistor configured to control an amount of a drain-to-source current of the driving transistor according to a voltage applied to the first node; an organic light emitting diode configured to emit light depending on the drain-to-source current of the driving transistor; a first transistor coupled between the second node and a data line of the data lines, the first transistor configured to be turned on by a scan signal applied to a scan line of the scan lines; a second transistor configured to initialize the first node by being turned on; and a first capacitor coupled between the first electrode and the second electrode of the second transistor.

11 Claims, 8 Drawing Sheets

(58) Field of Classification Search
USPC ..... 345/76, 77, 82, 690; 315/160, 169.3
See application file for complete search history.

(56) References Cited

U.S. PATENT DOCUMENTS

| | | | | |
|---|---|---|---|---|
| 2006/0022605 | A1* | 2/2006 | Ha | G09G 3/3233 315/169.3 |
| 2012/0001896 | A1* | 1/2012 | Han | G09G 3/3233 345/214 |
| 2012/0169693 | A1 | 7/2012 | Tsai et al. | |
| 2012/0287171 | A1 | 11/2012 | Mizukoshi et al. | |
| 2013/0063040 | A1* | 3/2013 | Huang | G09G 3/3225 315/232 |
| 2013/0335391 | A1* | 12/2013 | Kim | G09G 3/3291 345/211 |

OTHER PUBLICATIONS

Lee, Baek-Woon et al., "51.1: Novel Simultaneous Emission Driving Scheme for Crosstalk-free 3D AMOLED TV", SID 10 Digest, 2010, p. 758.

* cited by examiner

ORGANIC LIGHT EMITTING DISPLAY DEVICE AND METHOD FOR DRIVING THE SAME

CROSS-REFERENCE TO RELATED APPLICATION

This application claims priority to and the benefit of Korean Patent Application No. 10-2013-0134024, filed on Nov. 6, 2013, in the Korean Intellectual Property Office, the entire contents of which are incorporated herein by reference in their entirety.

BACKGROUND

1. Field

Aspects of embodiments of the present invention relate to an organic light emitting display device and a method for driving the same.

2. Description of the Related Art

With the development of an information-driven society, the demand for various types of display devices for displaying an image is increasing. Various flat panel displays such as liquid crystal display (LCDs), plasma display panels (PDPs), and organic light emitting diode (OLED) displays have been widely used in recent years. Among the flat panel displays, OLED displays are driven at a relatively low voltage, are relatively thin, have a relatively wide viewing angle, and have a relatively quick response speed.

A display panel of the OLED display may include a plurality of pixels arranged in a matrix form. Each of the pixels may include a scan transistor for supplying a data voltage of a data line in response to a scan signal of a scan line and a driving transistor for adjusting the amount of the current supplied to an organic light emitting diode in accordance with a voltage supplied to a gate electrode. The drain-to-source current Ids of the driving transistor supplied to the organic light emitting diode can be expressed according to the following equation:

$$I_{ds}=k\cdot(V_{gs}-V_{th})^2 \quad (1)$$

where k' represents a proportionality coefficient determined by the structure and physical properties of the driving transistor, Vgs represents the gate-source voltage of the driving transistor, and Vth represents the threshold voltage of the driving transistor.

The drain-to-source current Ids of the driving transistor depends upon the threshold voltage Vth of the driving transistor. However, the threshold voltage Vth of the driving transistor may shift or change as the driving transistor degrades over time. Additionally, such shifts in the threshold voltage Vth of the driving transistor may differ from pixel to pixel because degradation of the driving transistor differs from pixel to pixel. As a result, the luminance of light emitted from each of the pixels may differ even if the same data voltage is supplied to the pixels.

SUMMARY

Aspects of embodiments of the present invention include an organic light emitting display device and a method for driving the same, which may compensate for the threshold voltage of the driving transistor and minimize or reduce the luminance difference between white gray level images caused by the hysteresis characteristics of the driving transistor when displaying a white gray level image after displaying a black gray level image.

According to an aspect of embodiments of the present invention, an organic light emitting display device includes: a display panel including data lines, scan lines, initialization lines, and a plurality of pixels, wherein a pixel of the pixels includes: a driving transistor including a gate electrode coupled to a first node, a first electrode coupled to a second node, and a second electrode coupled to a third node, the driving transistor configured to control an amount of a drain-to-source current of the driving transistor according to a voltage applied to the first node; an organic light emitting diode configured to emit light depending on the drain-to-source current of the driving transistor; a first transistor coupled between the second node and a data line of the data lines, the first transistor configured to be turned on by a scan signal applied to a scan line of the scan lines; a second transistor configured to initialize the first node by being turned on; and a first capacitor coupled between the first electrode and the second electrode of the second transistor.

A gate electrode of the second transistor may be coupled to an initialization line of the initialization lines that is configured to supply an initialization signal, and a first electrode of the second transistor may be coupled to the first node.

A gate electrode of the second transistor may be coupled to an initialization line of the initialization lines that is configured to supply an initialization signal, a first electrode of the second transistor may be coupled to the first node, and a second electrode of the second transistor may be coupled to an initialization voltage line that is configured to supply an initialization voltage.

The first and second transistors may be configured to be turned on during a first period.

The pixel of the pixels may further include a third transistor coupled between the first node and the third node, and the third transistor may be configured to be turned on by the scan signal, and the third transistor may be configured to be turned on during the first period.

The first and the third transistors may be configured to be turned on and the second transistor may be configured to be turned off during a second period subsequent to the first period.

The display panel may further include emission lines, and the pixel may further include: a fourth transistor coupled between the second node and a first voltage supply line that is configured to supply a first power voltage, and the fourth transistor may be configured to be turned on by an emission signal of an emission line of the emission lines; and a fifth transistor coupled between the third node and the organic light emitting diode, and the fifth transistor may be configured to be turned on by the emission signal.

The fourth and fifth transistors may be configured to be turned off during the first period and the second period.

The first to third transistors may be configured to be turned off and the fourth and fifth transistors may be configured to be turned on during a third period subsequent to the second period.

The scan signal and an initialization signal applied to an initialization line of the initialization lines may be at a first logic level voltage and the emission signal may be at a second logic level voltage during the first period.

The scan signal may be at the first logic level voltage and the initialization signal and the emission signal may be at the second logic level voltage during the second period.

The emission signal may be at the first logic level voltage and the scan signal and the initialization signal may be at the second logic level voltage during the third period.

Each of the first to fifth transistors may be configured to be turned on by the first logic level voltage and to be turned off by the second logic level voltage.

Each of the first and second periods may include several horizontal periods or dozens of horizontal periods.

A gate electrode of the first transistor may be coupled to the scan line, a first electrode of the first transistor may be coupled to the data line, a second electrode of the first transistor may be coupled to the second node, a gate electrode of the third transistor and coupled to the scan line, a first electrode of the third transistor may be coupled to the third node, a second electrode of the third transistor may be coupled to the first node, a gate electrode of the fourth transistor may be coupled to the emission line, a first electrode of the fourth transistor may be coupled to the first voltage supply line, a second electrode of the fourth transistor may be coupled to the second node, a gate electrode of the fifth transistor may be coupled to the emission line, a first electrode of the fifth transistor may be coupled to the third node, a second electrode of the fifth transistor may be coupled to an anode of the organic light emitting diode, a cathode of the organic light emitting diode may be coupled to a second voltage supply line that may be configured to supply a second power voltage.

The pixel may further include a second capacitor coupled between the first node and a first voltage supply line that may be configured to supply a first power voltage.

According to an aspect of embodiments of the present invention, a method for driving an organic light emitting display device, the organic light emitting display device including a display panel including a plurality of pixels, wherein a pixel of the pixels includes a driving transistor configured to control a drain-to-source current flowing to an organic light emitting diode according to a voltage applied to a gate electrode of the driving transistor, the method including: supplying a gate on voltage to the driving transistor and initializing the gate electrode of the driving transistor; supplying a data voltage to the gate electrode of the driving transistor; and emitting light at the organic light emitting diode depending on the drain-to-source current of the driving transistor.

The method may further include supplying the data voltage to a first electrode of the driving transistor from a data line; electrically coupling the gate electrode of the driving transistor to a second electrode of the driving transistor; and electrically coupling the gate electrode of the driving transistor to an initialization voltage line that is configured to supply an initialization voltage.

The method may further include supplying the data voltage to a first electrode of the driving transistor from a data line; and electrically coupling the gate electrode of the driving transistor to a second electrode of the driving transistor.

The method may further include electrically coupling a first electrode of the driving transistor to a first voltage supply line that is configured to supply a first power voltage; and electrically coupling a second electrode of the driving transistor to the organic light emitting diode.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
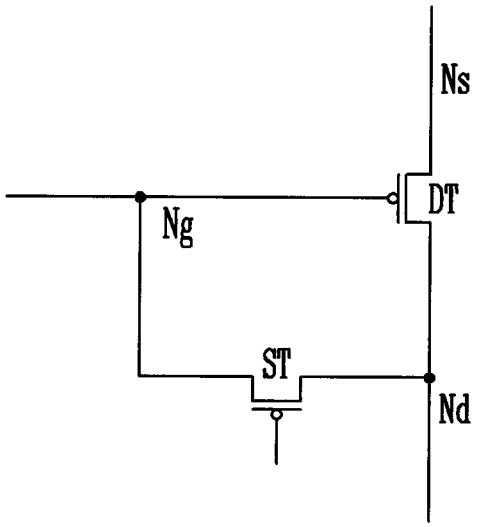
FIG. 1 is a circuit diagram showing a part of a diode-coupled threshold voltage compensation pixel structure.

Hereinafter, certain example embodiments according to the present invention will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals refer to like elements throughout.

FIG. 1 is a circuit diagram showing a part of a diode-coupled threshold voltage compensation pixel structure. FIG. 1 depicts a driving transistor DT for supplying a current to an organic light emitting diode and a switch transistor ST coupled between a gate node Ng and a drain node Nd.

Referring to FIG. 1, the switch transistor ST couples the gate node NG with the drain node Nd during a data voltage supply period that supplies a data voltage to a source node Ns, thus the driving transistor DT is diode-coupled. Thus, the voltage of the gate node Ng and the voltage of the drain node Nd have substantially the same potential. If a voltage difference Vgs between the gate node Ng and a source node Ns is greater than a threshold voltage of the driving transistor DT, the driving transistor DT forms a current path until the voltage difference Vgs between the gate node Ng and the source node Ns reaches the threshold voltage Vth of the driving TFT DT. As a result, the voltage of the gate node Ng and the voltage of the drain node Nd rise. Therefore, if a data voltage Vdata is supplied to the source node Ns, the voltage of the gate node Ng and the voltage of the drain node Nd reach a voltage difference Vdata−Vth between the data voltage Vdata and the threshold voltage Vth of the driving transistor DT. Consequently, the diode-coupled threshold voltage compensation pixel structure may delete or cancel out "Vth" in the above equation 1, thereby compensating for variations in the threshold voltage Vth of the driving transistor DT.

Figure 2:
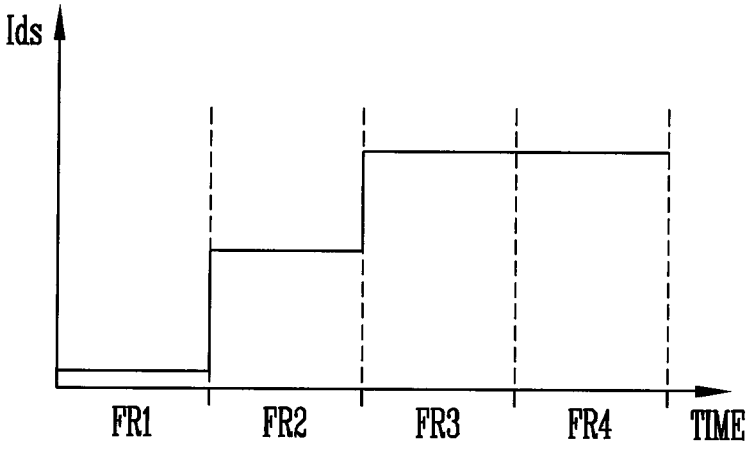
FIG. 2 is a graph illustrating the drain-to-source current of the driving transistor caused by the hysteresis characteristics of the driving transistor of FIG. 1.

FIG. 2 is a graph illustrating the drain-to-source current of the driving transistor caused by the hysteresis characteristics of the driving transistor of FIG. 1. In FIG. 2, a first frame period FR1 refers to a black gray level display period in which a pixel is represented as a black gray level. Each of second to fourth frame periods FR2 to FR4 refers to a white gray level display period in which the pixel is represented as a white gray level.

Referring to FIG. 2, the drain-to-source current of the driving transistor DT increases as steps by the hysteresis characteristics of the driving transistor DT when a pixel represents a white gray level after representing a black gray level. It may occur when the driving transistor DT is formed by a low temperature Poly-Si (LTPS) process.

For example, the drain-to-source current of the driving transistor DT increases as steps (e.g., increases by incremental levels for sequential frame period) during the first to fourth frame periods due to a difference of the drain-to-source current of the driving transistor DT between an on bias state and an off bias state. The on bias state refers to a state at which the driving transistor DT is turned on and the drain-to-source current Ids flows through a channel of the driving transistor DT. A white gray level voltage is supplied to the gate electrode of the driving transistor DT so that the driving transistor is at the on bias state. The off bias state refers to the driving transistor DT is turned off (e.g., the drain-to-source current Ids hardly flows through the channel of the driving transistor DT). A black gray level voltage is supplied to the gate electrode of the driving transistor DT so that the driving transistor is at the off bias state. The white gray level voltage refers to a voltage for emitting an organic light emitting diode as a white gray level. The black gray level voltage refers to a voltage for emitting an organic light emitting diode as a black gray level.

The black gray level voltage is supplied to the gate electrode of the driving transistor DT during the first frame period FR1. Thus, the driving transistor DT is at the off bias state during the second frame period FR2. Also, because the white gray level voltage is supplied to the gate electrode of the driving transistor DT during the second frame period FR2, the driving transistor DT is at on bias state during the third frame period. That is, the driving transistor DT is not at the same bias state during the second and third frame period FR2, FR3 even though the same white grayscale voltage is supplied to the gate electrode of the driving transistor DT.

As a result, as shown in FIG. 2, the drain-to-source current of the driving transistor DT during the second frame period FR2 is lower than during the third frame period FR3 even though the same white grayscale voltage is supplied to the gate electrode of the driving transistor DT. Therefore, the luminance of light which an organic light emitting diode emits during the second frame period FR2 is lower than during the third frame period FR3. Accordingly, a picture quality may be lowered due to a luminance difference between the second frame period FR2 and the third frame period FR3.

An embodiment of the present invention is provided to improve a picture quality by minimizing a luminance difference between white grayscale display periods caused by the hysteresis characteristics of the driving transistor DT. Hereinafter, the embodiment of the present invention will be described in detail in conjunction with FIGS. 3 to 11.

Figure 3:
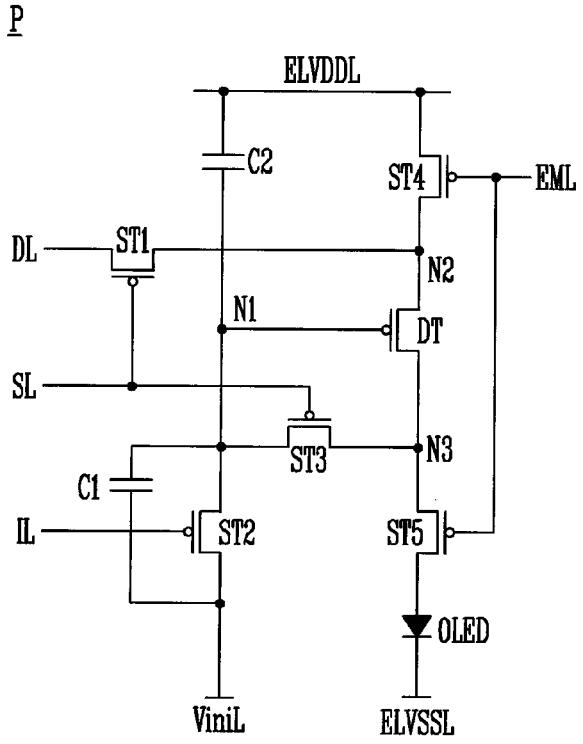
FIG. 3 is an equivalent circuit diagram of a pixel according to a first example embodiment.

FIG. 3 is an equivalent circuit diagram of a pixel according to a first example embodiment. Referring to FIG. 3, a pixel according to the first example embodiment is coupled to a scan line SL, a data line DL, an initialization line IL, and an emission line EML. Also, the pixel according to the first example embodiment is coupled to first and second voltage supply lines ELVDDL, ELVSSL and an initialization voltage line ViniL.

The pixel according to the first example embodiment includes a driving transistor DT, an organic light emitting diode OLED, switch elements, and a plurality of capacitors C1, C2. The switch elements include first to fifth transistors. ST1 to ST5.

The driving transistor DT controls the amount of drain-to-source current according to the level of a voltage applied to a gate electrode of the driving transistor DT. The drain-to-source current Ids of the driving transistor DT is proportional to the square of a difference between the gate-source voltage Vgs of the driving transistor and the threshold voltage Vth of the driving transistor as described in the above equation 1. A gate electrode of the driving transistor DT is coupled to a first node N1, a first electrode thereof is coupled to a second node N2, and a drain electrode thereof is coupled to a third node N3. Here, the first electrode may be a source or a drain electrode, and the second electrode may be a different electrode with the first electrode. For example, if the first electrode is the source electrode, the second electrode may be the drain electrode.

The organic light emitting diode OLED emits light depending on the drain-to-source current Ids of the driving TFT DT. An anode of the organic light emitting diode OLED is coupled to a second electrode of the fifth transistor ST5 and a cathode thereof is coupled to a second voltage supply line ELVSSL supplying a second power voltage ELVSS. The luminance of light emitted by the organic light emitting diode OLED is proportion to the drain-to-source current Ids of the driving transistor DT.

The first transistor ST1 is coupled between the second node N2 and the data line DL. The first transistor ST1 is turned on by a scan signal from the scan line SL. When the first transistor ST1 is turned on, the second node N2 is coupled to the data line DL, thus a data voltage Vdata from the data line DL is supplied to the second node N2. A gate electrode of the first transistor ST1 is coupled to the scan line SL, a first electrode thereof is coupled to the data line DL, and a second electrode thereof is coupled to the second node N2.

The second transistor ST2 is coupled between the first node N1 and the initialization voltage line ViniL supplying an initialization voltage Vini. The second transistor ST2 is turned on by an initialization signal from the initialization line IL. When the second transistor ST2 is turned on, the first node N1 is coupled to the initialization voltage line ViniL, thus the first node N1 is initialized to the initialization voltage Vini. A gate electrode of the second transistor ST2 is coupled to the initialization line IL, a first electrode thereof is coupled to the first node N1, and a second electrode thereof is coupled to the initialization voltage line ViniL.

The third transistor ST3 is coupled between the first node N1 and the third node N3. The third transistor ST3 is turned on by the scan signal from the scan line SL. When the third transistor ST3 is turned on, the first node N1 is coupled to the third node N3, thus the driving transistor DT is diode-coupled. A gate electrode of the third transistor ST3 is coupled to the scan line SL, a first electrode thereof is coupled to the third node N3, and a second electrode thereof is coupled to the first node N1.

The fourth transistor ST4 is coupled between the second node N2 and the first voltage supply line ELVDDL supplying a first power voltage ELVDD. The fourth transistor ST4 is turned on by an emission signal from the emission line EML. When the fourth transistor ST4 is turned on, the second node N2 is coupled to the first voltage supply line ELVDDL, thus the first power voltage ELVDD is supplied to the second node N2. A gate electrode of the fourth transistor ST4 is coupled to the emission line EML, a first electrode thereof is coupled to the first voltage supply line ELVDDL, and a second electrode thereof is coupled to the second node N2.

The fifth transistor ST5 is coupled between the third node N3 and the anode of the organic light emitting diode OLED. The fifth transistor ST5 is turned on by the emission signal from the emission line EML. When the fifth transistor ST5 is turned on, the third node N3 is coupled to the anode of the organic light emitting diode OLED. A gate electrode of the fifth transistor ST5 is coupled to the emission line EML, a first electrode of the fifth transistor ST5 is coupled to the third node N3, and a second electrode of the fifth transistor ST5 is coupled to the anode of the organic light emitting diode OLED. When the fourth and fifth transistors are turned-on, the drain-to-source current Ids of the driving transistor DT is supplied to the organic light emitting diode OLED.

The first capacitor C1 is coupled between the first electrode and the second electrode of the second transistor ST2. That is, one electrode of the first capacitor C1 is coupled to the first electrode of the second transistor ST2 and the other electrode of the first capacitor C1 is coupled to the second electrode of the second transistor ST2. Because the first electrode of the second transistor ST2 is coupled to the first node N1 and the second electrode of the second transistor ST2 is coupled to the initialization voltage line ViniL, the first capacitor C1 is coupled between the first node N1 and the initialization voltage line ViniL.

The second capacitor C2 is coupled between the first node N1 and the first voltage supply line ELVDDL. That is, one electrode of the second capacitor C2 is coupled to the first node N1 and the other electrode of the second capacitor C2 is coupled to the first voltage supply line ELVDDL.

The first node N1 is a gate node coupled to the gate electrode of the driving transistor DT. The first node N1 is a contact point at which the gate electrode of the driving TFT DT, the first electrode of the second transistor ST2, the second electrode of the third transistor ST3, one electrode of the first capacitor C1, and one electrode of the second capacitor C2 are each mutually electrically coupled. The second node N2 is a source node coupled to the first electrode of the driving transistor DT. The second node N2 is a contact point at which the first electrode of the driving transistor DT, the second electrode of the first transistor ST1, and the second electrode of the fourth transistor ST4 are each mutually electrically coupled. The third node N3 is a drain node coupled to the second electrode of the driving transistor DT. The third node N3 is a contact point at which the second electrode of the driving transistor DT, the first electrode of the third transistor ST3, and the first electrode of the fifth transistor ST5 are each mutually electrically coupled.

Semiconductor layers of the first to fifth transistors ST1 to ST5 and the driving transistor DT have been described as being formed of Poly-Si by a low temperature Poly-Si (LTPS) process. However, the embodiments are not limited thereto, and the semiconductor layers of the first to fifth transistors ST1 to ST5 and the driving transistor DT may be formed of either a-Si or an oxide semiconductor, or other suitable semiconductor material.

Also, the first example embodiment has been described with respect to an example in which the first to fifth transistors ST1 to ST5 and the driving transistor DT are implemented as P-type MOSFETs (Metal Oxide Semiconductor Field Effect Transistors). However, the present invention is not limited thereto, and the first to fifth transistors ST1 to ST5 and the driving transistor DT may be implemented as N-type MOSFETs. When the first to fifth transistors ST1 to ST5 and the driving transistor DT are implemented as N-type MOSFETs, a waveform diagram shown in FIG. 4 may be modified in accordance with the characteristics of the N-type MOSFETs.

The first and the second power voltage ELVDD, ELVSS, and the initialization voltage Vini are set after consideration of the characteristics of the driving TFT DT and the first to fifth transistors ST1 to ST5, the characteristics of the organic light emitting diode OLED, and so on. The first power voltage ELVDD may be set to a voltage higher than the second power voltage ELVSS. A voltage which subtracts the initialization voltage Vini from the data voltage Vdata may be lower than the threshold voltage Vth of the driving transistor DT.

Figure 4:
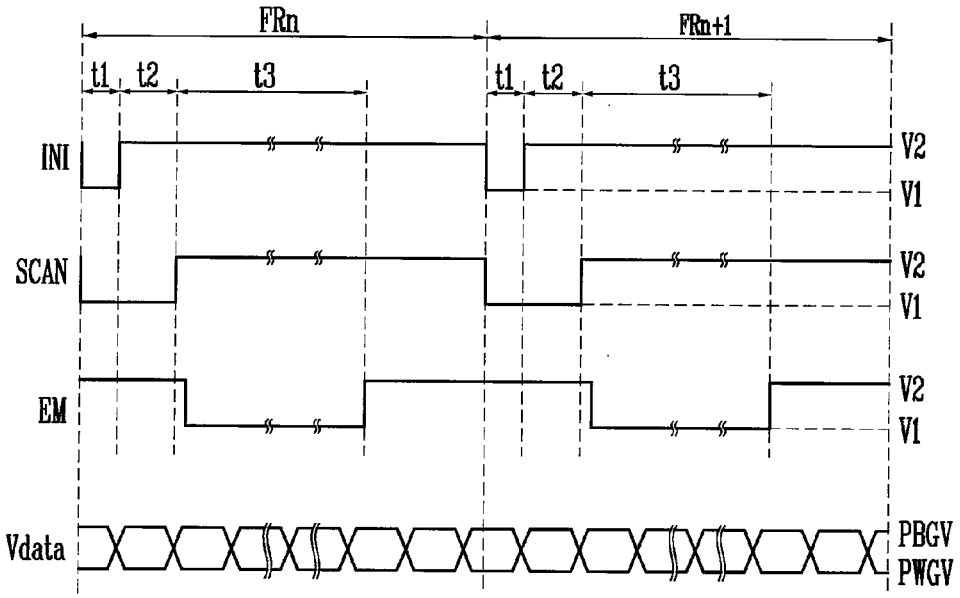
FIG. 4 is a waveform diagram showing signals which are input into a pixel according to a first example embodiment.

FIG. 4 is a waveform diagram showing signals that are input into a pixel according to a first example embodiment. FIG. 4 depicts an initialization signal INI, a scan signal SCAN, and an emission signal EM input to a pixel P during n-th (n is a positive integer) and (n+1)-th frame periods FRn, FRn+1. Also, FIG. 4 depicts a data voltage Vdata supplying to a data line DL during the n-th and (n+1)-th frame periods FRn, FRn+1.

Referring to FIG. 4, the initialization signal INI, the scan signal SCAN, and the emission signal EM are for controlling the first to fifth transistors ST1 to ST5 of the pixel P. The initialization signal INI is supplied to the pixel P through an initialization line IL, the scan signal SCAN is supplied to the pixel P through a scan line SL, and the emission signal EM is supplied to the pixel P through an emission line EML.

Each of the initialization signal INI, the scan signal SCAN, and the emission signal EM may be generated as a cycle of one frame period. Each of the initialization signal INI, the scan signal SCAN, and the emission signal EM swings between a first logic level voltage V1 and a second logic level voltage V2. As shown in FIG. 4, the first logic level voltage V1 is implemented as a gate on voltage and the second logic level voltage V2 is implemented as a gate off voltage. The gate on voltage is a turn-on voltage turning on the first to fifth transistors ST1 to ST5 when the gate on voltage is supplied to the gate electrodes of the first to fifth transistors ST1 to ST5. The gate off voltage is a turn-off voltage turning off the first to fifth transistors ST1 to ST5 when the gate off voltage is supplied to the gate electrode of the first to fifth transistors ST1 to ST5.

The data voltage Vdata is supplied to the data line DL as a cycle of a predetermined period. For example, the data voltage Vdata may be supplied to the data line DL as a cycle of one horizontal period. The one horizontal period refers to one horizontal line data supplying period that supplies data voltages to pixels arranged on a horizontal line. Here, the pixels arranged on a horizontal line refer to pixels coupled to one scan line. As shown in FIG. 4, the third period t3 that supplies the data voltage Vdata to the pixel P may be one horizontal period, however, the embodiments are not limited thereto.

The data voltage Vdata has a voltage level from a peak white gray level voltage PWGV to a peak black gray level voltage PBGV. When the peak white gray level voltage PWGV is supplied to the pixel P as the data voltage Vdata, the organic light emitting diode OLED emits as the peak white gray level. When the peak black gray level voltage PBGV is supplied to the pixel P as the data voltage Vdata, the organic light emitting diode OLED emits as the peak black gray level.

One frame period includes first to third periods t1 to t3. The first period t1 is a period that initializes the first node N1. Also, the first period t1 is a period that turns on the driving transistor DT so that the driving transistor DT is at the on bias state. The second period t2 is a period that supplies a data voltage Vdata to the first node N1. A third period t3 is a period that emits an organic light emitting diode OLED depending on the drain-to-source current Ids of the driving transistor DT.

The scan signal SCAN and the initialization signal INI are generated as the first logic level voltage V1, and the emission signal EM is generated as the second logic level voltage V2 during the first period t1. The scan signal SCAN is generated as the first logic level voltage V1, and the initialization signal INI and the emission signal EM are generated as the second logic level voltage V2 during the second period t2. The emission signal EM is generated as the first logic level voltage V1, and the scan signal SCAN and the initialization signal INI are generated as the second logic level voltage V2 during the third period t3. Meanwhile, the first and second periods t1 and t2 are several horizontal periods or dozens of horizontal periods for improving a picture quality.

Figure 5:
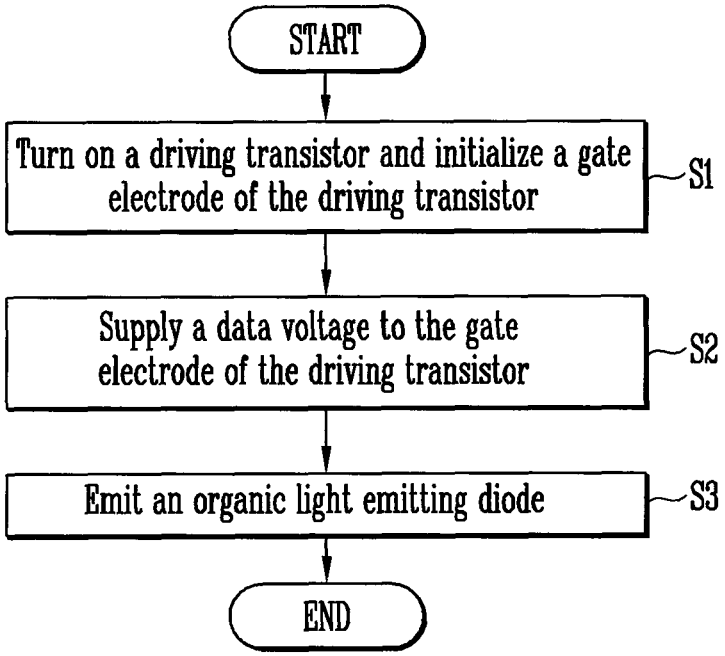
FIG. 5 is a flow chart illustrating a method for driving a pixel according to a first example embodiment.
Figure 6A:
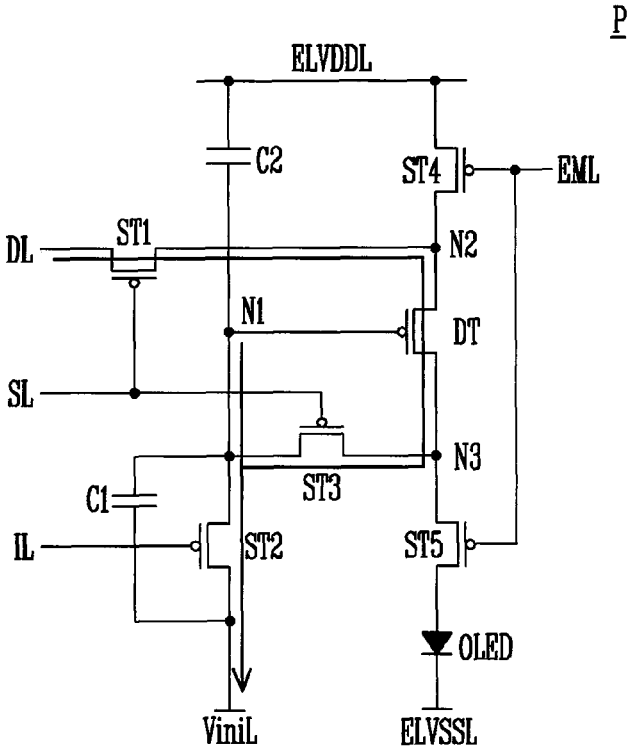
FIGS. 6A to 6C are circuit diagrams of a pixel according to a first example embodiment during first to third periods.
Figure 6B:
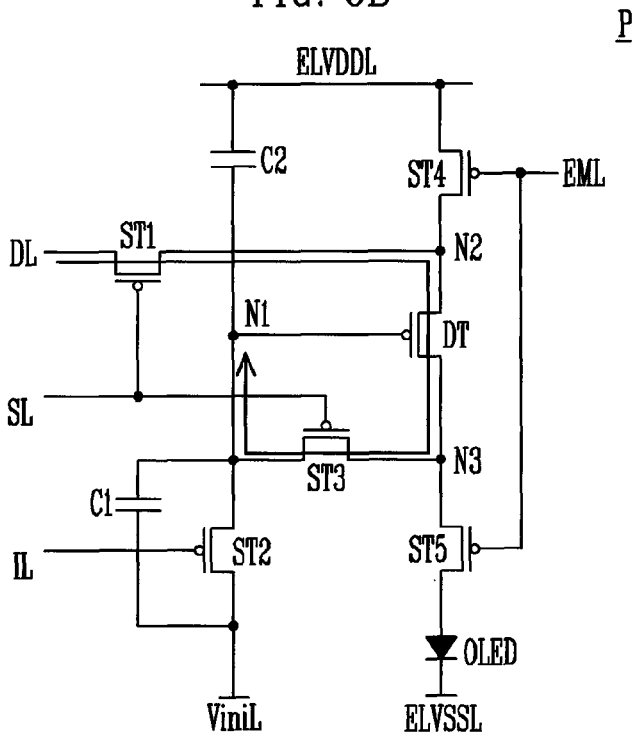
Figure 6C:
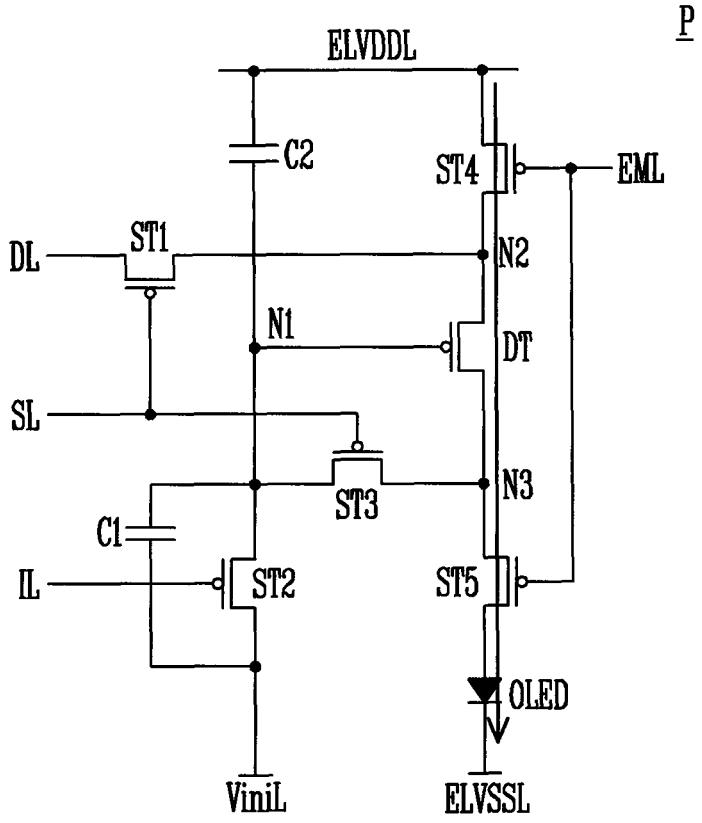

FIG. 5 is a flow chart illustrating a method for driving a pixel according to an example embodiment. FIGS. 6A to 6C are circuit diagrams of a pixel according to an example embodiment during first to third periods. The method for driving the pixel P according to the embodiment during the first to third periods t1 to t3 is described in detail in conjunction with FIGS. 4, 5 and 6A to 6C.

First, as shown in FIG. 4, during the first period t1 that initializes the first node N1 and turns on the driving transistor DT, the scan signal SCAN having the first logic level voltage V1 is supplied to the pixel P through the scan line SL. The initialization signal INI having the first logic level voltage V1 is supplied to the pixel P through the initialization line IL during the first period t1. The emission signal EM having the second level voltage V2 is supplied to the pixel P through the emission line EML during the first period t1.

Referring to FIG. 6A, during the first period t1, the first and the third transistors ST1, ST3 are turned on by the scan signal SCAN having the first logic level voltage V1. The second transistor ST2 is turned on by the initialization signal INI having the first logic level voltage V1. The fourth and the fifth transistors ST4 and ST5 are turned off by the emission signal EM having the second logic level voltage V2.

The second node N2 is electrically coupled to the data line DL, because the first transistor ST1 is turned on. The first node N1 is electrically coupled to the third node N3, because the third transistor ST3 is turned on, thus the driving transistor DT is diode-coupled. The first node N1 is coupled to the initialization voltage line ViniL since the second transistor ST2 is turned on. Therefore, a voltage of the first node N1 is initialized to a voltage MV between the data voltage Vdata and the initialization voltage Vini during the first period t1. The effect obtained from initializing the first node N1 to the voltage MV between the data voltage Vdata and the initialization voltage Vini is described with reference to FIGS. 8*a*, 8*b*, 9*a*, and 9*b*.

Also, the embodiment may turn on the driving transistor DT because the data voltage Vdata is supplied to the second node N2 and the initialization voltage Vini is supplied to the first node N1 during the first period t1. Thus, the drain-to-source current Ids of the driving transistor DT flows during the first period t1. Therefore, the driving transistor DT may be at the on bias state before the third period t3 that supplies the data voltage Vdata to the gate electrode of the driving transistor DT. Accordingly, the embodiment may improve picture quality due to the hysteresis characteristics of the driving transistor DT, which will be described in more detail with respect to FIG. 7. (See S1 in FIG. 5)

Second, as shown in FIG. 4, during the second period t2 that supplies the data voltage Vdata to the first node N1, the scan signal SCAN having the first logic level voltage V1 is supplied to the pixel P through the scan line SL. The initialization signal INI having the second logic level voltage V2 is supplied to the pixel P through the initialization line IL during the second period t2. The emission signal EM having the second level voltage V2 is supplied to the pixel P through the emission line EML during the second period t2.

Referring to FIG. 6B, the first and the third transistors ST1 and ST3 are turned on by the scan signal SCAN having the first logic level voltage V1. The second transistor ST2 is turned off by the initialization signal INI having the second logic level voltage V1. The fourth and the fifth transistors ST4 and ST5 are turned off by the emission signal EM having the second logic level voltage V2.

The second node N2 is electrically coupled to the data line DL, because the first transistor ST1 is turned on, thus the data voltage Vdata is supplied to the second node N2. The first node N1 is electrically coupled to the third node N3 because the third transistor ST3 is turned on, thus the driving transistor DT is diode-coupled.

Because the gate-source voltage "VM−Vdata" of the driving transistor DT is lower than the threshold voltage Vth, the drain-to-source current Ids of the driving transistor DT flows until the gate-source voltage of the driving transistor DT reaches the threshold voltage Vth. Therefore, the voltage of the first node N1 rises up to "Vdata+Vth". The voltage "Vdata+Vth" of the first node N1 is stored to the first and second capacitor C1, C2. That is, the threshold voltage Vth of the driving transistor DT may be sensed by the first and second capacitor C1, C2 during the second period t2. (See S2 in FIG. 5)

Third, as shown in FIG. 4, during the third period t3 that emits the organic light emitting diode, the scan signal SCAN having the second logic level voltage V2 is supplied to the pixel P through the scan line SL. The initialization signal INI having the second logic level voltage V2 is supplied to the pixel P through the initialization line IL during the third period t3. The emission signal EM having the first level voltage V1 is supplied to the pixel P through the emission line EML during the third period t3.

Referring to FIG. 6C, the first and the third transistors ST1 and ST3 are turned off by the scan signal SCAN having the second logic level voltage V2. The second transistor ST2 is turned off by the initialization signal INI having the second logic level voltage V1. The fourth and the fifth transistors ST4 and ST5 are turned on by the emission signal EM having the first logic level voltage V1.

The second node N2 is coupled to the first supply voltage line ELVDDL, because the fourth transistor ST4 is turned on. The third node N3 is electrically coupled to the anode of the organic light emitting diode OLED, because the fifth transistor ST5 is turned on. Therefore, the drain-to-source current Ids of the driving transistor DT is supplied to the organic light emitting diode OLED. Especially, because the voltage "Vdata+Vth" of the first node N1 is stored to the first and second capacitor C1, C2, the drain-to-source current Ids of the driving transistor DT is expressed in following equation:

$$I_{ds}=k'(V_{gs}-V_{th})^2=k'((V\text{data}+Vth-ELVDD)-Vth)^2 \quad (2)$$

where k' represents a proportionality coefficient determined by the structure and physical properties of the driving transistor DT, Vgs represents the gate-source voltage of the driving transistor DT, Vth represents the threshold voltage of the driving transistor DT, Vdata represents the data voltage, and the ELVDD represents the first power voltage. The gate voltage Vg of the driving transistor DT is Vdata+Vth, and the source voltage Vs of the driving transistor DT is ELVDD during the third period t3. To sum up equation 2, the drain-to-source current Ids of the driving transistor DT is derived as expressed in the following equation:

$$I_{ds}=k'(V\text{data}-ELVDD)^2 \quad (3)$$

Accordingly, the drain-to-source current Ids does not depend on the threshold voltage Vth of the driving transistor DT as in equation 3. That is, the embodiment may compensate the threshold voltage Vth of the driving transistor DT. (See S3 in FIG. 5)

Figure 7:
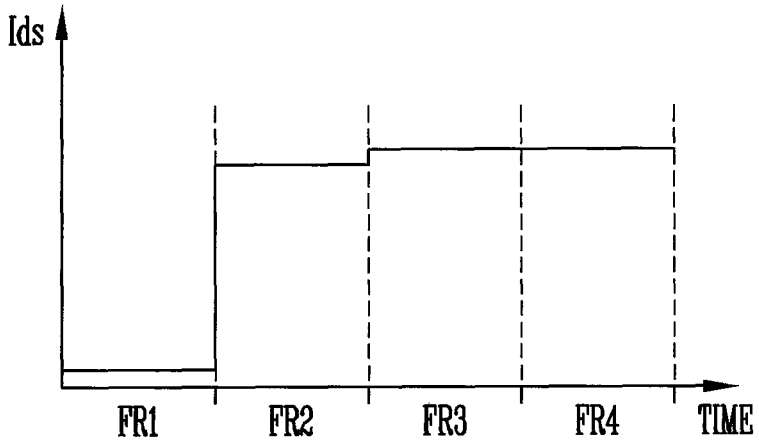
FIG. 7 is a graph illustrating the drain-to-source current of the driving transistor caused by the hysteresis characteristics of the driving transistor according to a first example embodiment.

FIG. 7 is a graph illustrating the drain-to-source current of the driving transistor caused by the hysteresis characteristics of the driving transistor according to an example embodiment. In FIG. 7, a first frame period FR1 refers to a black gray level display period in which a pixel is represented as a black gray level. Each of second to fourth frame periods FR2 to FR4 refers to a white gray level display period in which the pixel is represented as a white gray level.

Referring to FIG. 7, the embodiment supplies the initialization voltage Vini the gate electrode of the driving transistor DT and the data voltage Vdata the first electrode of the driving transistor DT during the first period t1 of every frame period. Therefore, according to the embodiment, the driving transistor DT may be at the on bias state during the second period t2 that supplies the data voltage Vdata to the gate electrode of the driving transistor DT regardless of a gray level voltage supplied during a previous frame period.

As shown in FIG. 7, even though the peak black gray level voltage is supplied to the gate electrode of the driving transistor DT during the first frame period FR1, the driving transistor DT is at the on bias state during the second period t2 of the second frame period FR2 that supplies the data voltage Vdata, because the driving transistor DT is turned on and the drain-to-source current Ids of the driving transistor DT flows during the first period t1 of the second frame period FR2. Therefore, the drain-to-source current Ids of the driving transistor DT during the second frame period FR2 is almost same as during the third frame period FR3. Consequently, the organic light emitting diode OLED may emit as the peak white gray level during the second frame period FR2.

Accordingly, the embodiment may prevent or reduce instances of the drain-to-source current of the driving transistor DT increasing as steps (e.g., increasing incrementally for subsequent frame periods) due to the hysteresis characteristics of the driving transistor in the case of displaying a white gray level image after displaying a black gray level image. Therefore, the embodiment may minimize the luminance difference between white gray level images caused by the hysteresis characteristics of the driving transistor in the case of displaying a white gray level image after displaying a black gray level image, and accordingly improve a picture quality.

Figure 8A:
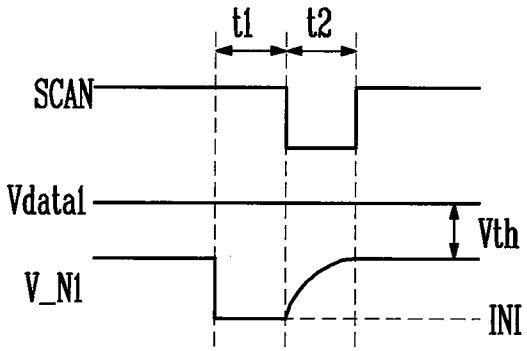
FIGS. 8A and 8B are waveform diagrams showing scan signal, data voltage, and a voltage of a first node during first and second periods in the related art.
Figure 8B:
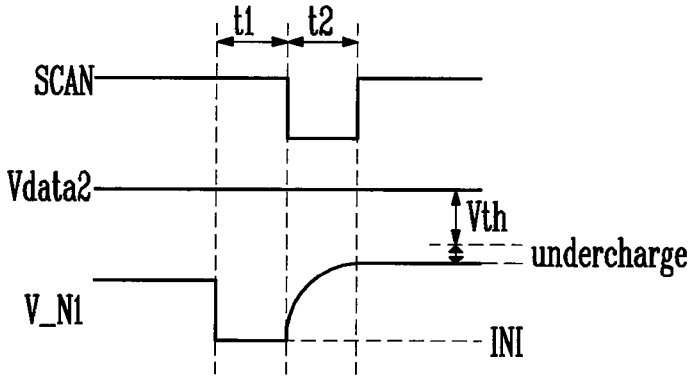
Figure 9A:
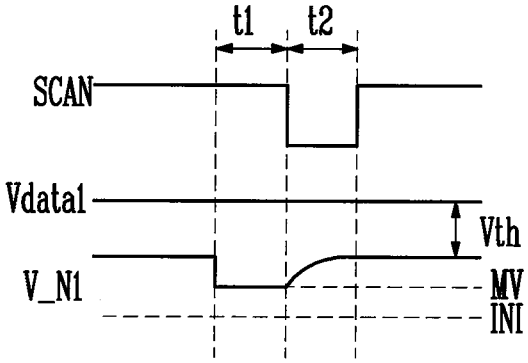
FIGS. 9A and 9B are waveform diagrams showing scan signal, data voltage, and a voltage of a first node during first and second periods according to the first embodiment.
Figure 9B:
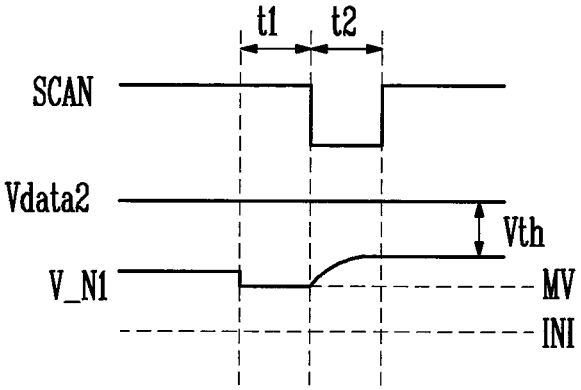

FIGS. 8A and 8B are waveform diagrams showing scan signal, data voltage, and a voltage of a first node during first and second periods in the related art. FIGS. 9A and 9B are waveform diagrams showing scan signal, data voltage, and a voltage of a first node during first and second periods according to the first embodiment.

Referring to FIGS. 8A, 8B, 9A, and 9B, SCAN represents a scan signal, Vdata1 represents a first data voltage, Vdata2 represents a second data voltage, V_N1 represents a voltage of a first node N1. The first data voltage Vdata1 is a voltage lower than the second data voltage Vdata2. For example, the second data voltage Vdata2 may be a peak black gray level voltage and the first data voltage Vdata1 may be any voltage lower than the second data voltage Vdata2.

The first node N1 is initialized to an initialization voltage Vini during an initialization period in the related art. When the first data voltage Vdata1 is supplied during a data voltage supply period, in the related art the first node N1 may be charged to "Vdata1−Vth" corresponding to a target voltage, because a voltage difference between the first data voltage Vdata1 and the initialization voltage Vini is small. However, when the second data voltage Vdata2 is supplied during a data voltage supply period, in the related art the first node N1 may not be charged to "Vdata2−Vth" corresponding to the target voltage, because a voltage difference between the second data voltage Vdata2 and the initialization voltage Vini is large. For example, if a display panel has a resolution of an ultra high definition (UHD), the data voltage supply period shortens. Thus, there is a high probability of not being charged to "Vdata2−Vth" corresponding to the target voltage in the related art. Therefore, the related art may not represent a gray level which wants to represent as the second data voltage Vdata2, thus a contrast ratio may be lowered.

The first node N1 is initialized to a voltage MV between a data voltage and an initialization voltage Vini during a first period t1 corresponding to the initialization period according to the first embodiment. The first embodiment may decrease a voltage difference between the voltage MV between a data voltage and an initialization voltage Vini and a data voltage supplied during a second period t2 corresponding to the data voltage supply period. Therefore, the first node may be charged to "Vdata2−Vth" corresponding to the target voltage even if the second data voltage Vdata2 is supplied to the second period t2. Finally, the first embodiment may solve a problem of the related art, thus prevent or reduce instances of the contrast ratio being lowered.

Figure 10:
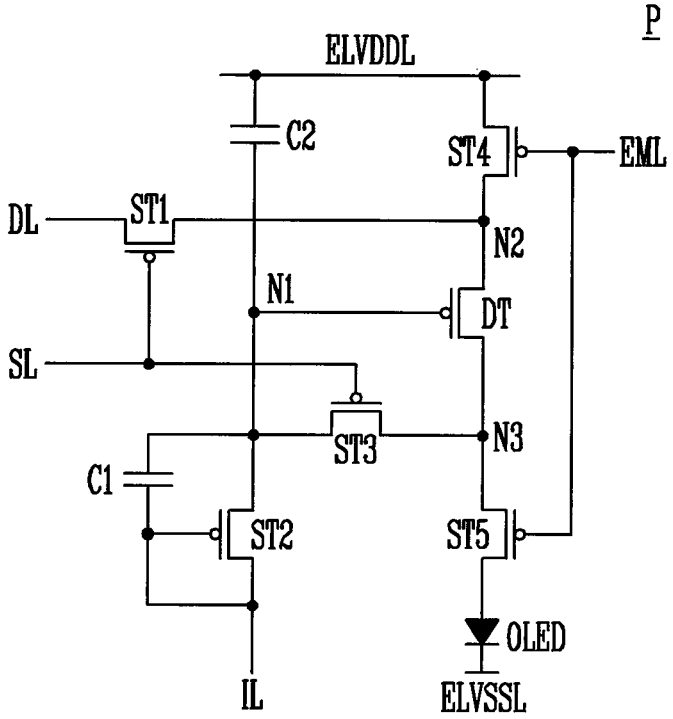
FIG. 10 is an equivalent circuit diagram of a pixel according to a second example embodiment.

FIG. 10 is an equivalent circuit diagram of a pixel according to a second example embodiment. Referring to FIG. 10, a pixel according to the second example embodiment is coupled to a scan line SL, a data line DL, an initialization line IL, and an emission line EML. Also, the pixel according to the second example embodiment is coupled to first and second voltage supply lines ELVDDL, ELVSSL and an initialization voltage line ViniL.

The pixel according to the second example embodiment includes a driving transistor DT, an organic light emitting diode OLED, switch elements, and first and second capacitors C1, C2. The switch elements include first to fifth transistors. ST1 to ST5.

The pixel according to the second example embodiment is substantially same as the pixel according to the first example embodiment except the second transistor ST2 and the first capacitor C1. Therefore, some repetitive description of the driving transistor DT, the organic light emitting diode OLED, the first and third to fifth transistors ST1, ST3, ST4, ST5, and the second capacitor C2 of the pixel according to the second example embodiment is omitted.

The second transistor ST2 is turned on by an initialization signal INI from an initialization line IL. When the second transistor ST2 is turned on, the first node N1 is coupled to the initialization line IL, thus the first node N1 is initialized to a voltage of the initialization signal INI. For example, if the second transistor ST is turned on by a first logic level voltage V1 of the initialization signal INI, the first node N1 is initialized to the first logic level voltage V1. A gate electrode and a second electrode of the second transistor ST2 are coupled to the initialization line IL, a first electrode thereof is coupled to the first node N1. That is, the second transistor ST2 is diode-coupled.

The first capacitor C1 is coupled between the first electrode and the second electrode of the second transistor ST2. That is, one electrode of the first capacitor C1 is coupled to the first electrode of the second transistor ST2 and the other electrode of the first capacitor C1 is coupled to the second electrode of the second transistor ST2. Because the second electrode of the second transistor ST2 is coupled to the gate electrode thereof, the first capacitor C1 is coupled between the gate electrode and the first electrode of the second transistor ST2. Because the first electrode of the second transistor ST2 is coupled to the first node N1 and the second electrode thereof is coupled to the initialization line IL, the first capacitor C1 is coupled between the first node N1 and the initialization line IL.

The pixel P according to the second embodiment does not need an initialization voltage line ViniL supplying an initialization voltage Vini due to the second transistor ST2. Therefore, the second embodiment may decrease a voltage input line formed on a display panel in comparison with the first embodiment. As a result, the second embodiment may have a more space for forming the pixel P more than the first embodiment.

Also, a voltage change of the initialization line IL is applied to the first node N1 by the cap boosting of the first capacitor C1 since the first capacitor C1 is coupled between the first node N1 and the initialization line IL according to the second embodiment. For example, as shown in FIG. 4, when the initialization signal INI is generated as a first logic level voltage V1 during a first period t1 and is generated as a second logic level voltage V2 during a second period t2, the voltage change of the initialization line IL is applied to the first node N1 by the cap boosting of the first capacitor C1. Therefore, the second embodiment may further decrease a voltage difference between the voltage MV between an initialization voltage Vini and a data voltage supplied during a second period t2 corresponding to the data voltage supply period, in comparison to the first embodiment. Accordingly, the second embodiment may prevent or reduce instances of the contrast ratio being lowered.

Meanwhile, a scan signal SCAN, an initialization signal INI, an emission signal EM, and a data voltage Vdata supplied to the pixel P according the second embodiment are substantially same as those shown in FIG. 4. Therefore, some repetitive description of the scan signal SCAN, the initialization signal INI, the emission signal EM, and the data voltage Vdata supplied to the pixel P according the second embodiment is omitted. Also, the operation of the pixel P according to the second embodiment is substantially same as the operation of the pixel P according to the first embodiment as shown in FIGS. 5 and 6A to 6C. Therefore, some repetitive description of the operation of the pixel P according to the second embodiment is omitted.

Figure 11:
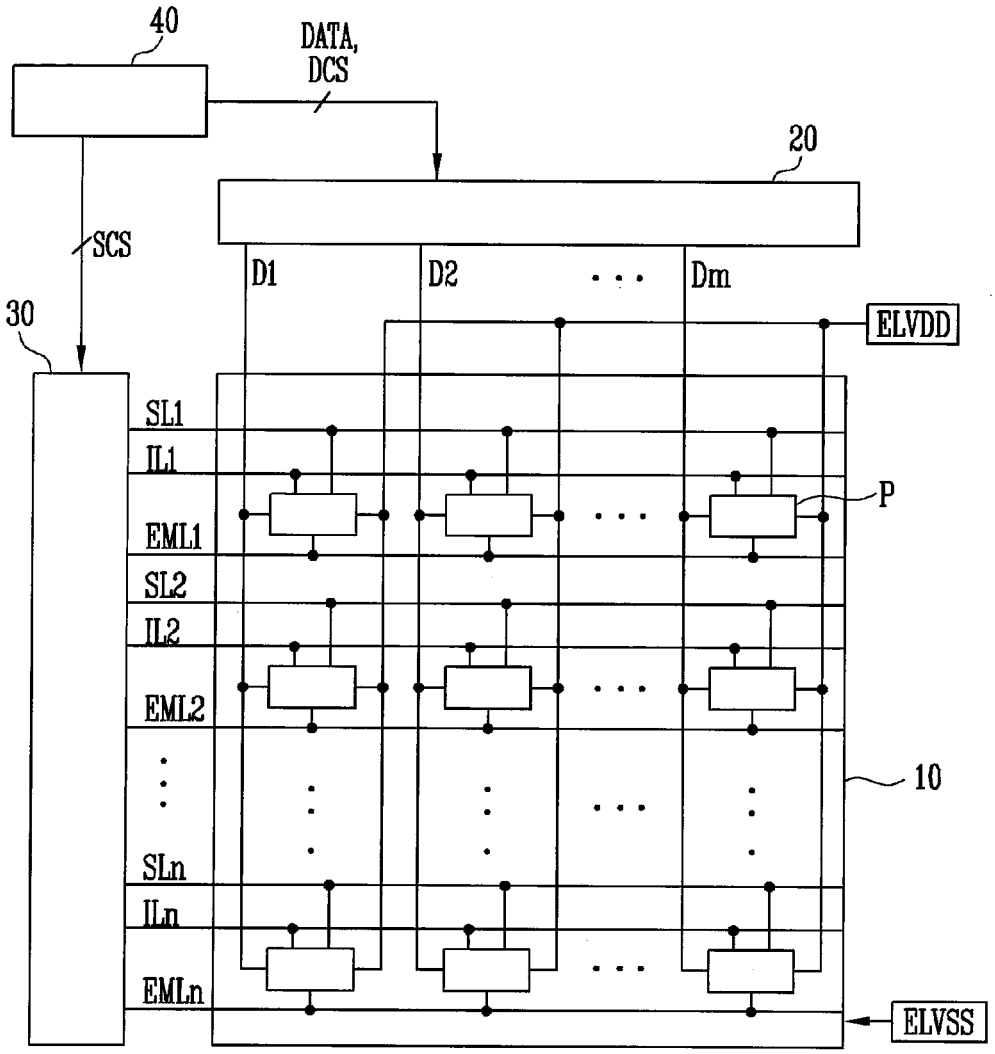
FIG. 11 is a block diagram schematically showing an organic light emitting display device according to an example embodiment.

FIG. 11 is a block diagram schematically showing an organic light emitting display device according to an example embodiment. Referring to FIG. 8, the organic light emitting display device according to the example embodiment comprises a display panel 10, a data driver 20, a scan driver 30, a timing controller 40, and a power supply unit 50.

Data lines D1 to Dm and scan lines SL1 to SLn crossing each other are formed on the display panel 10, wherein m is a positive integer equal to and greater than 2 and n is a positive integer equal to and greater than 2. Also, Initialization lines IL1 to ILn and emission lines EML1 to EMLn may be formed in parallel with the scan lines SL1 to SLn on the display panel 10. Also, pixels P are arranged in a matrix form on the display panel 10. Each of the pixels P is as described in conjunction with FIGS. 3 and 10.

The data driver 20 comprises a plurality of source drive ICs. The source drive ICs receive digital video data RGB from the timing controller 40. The source drive ICs convert the digital video data RGB into a gamma compensation voltage in response to a source timing control signal DCS from the timing controller 40 to generate data voltages. The source drive ICs supply the data voltages to the data lines D1 to Dm of the display panel 10 in synchronization with scan signals SCAN. Therefore, the data voltages are supplied to pixels to which a scan signal SCAN is supplied.

The scan driver 30 includes a scan signal output part, an initialization signal output part, and an emission signal output part. Each of the scan signal output part, the initialization signal output part, and the emission signal output part may have a shift register for sequentially outputting signals, a level shifter for shifting the signals of the shift register to a swing width suitable for transistors of the pixels, a buffer, and the like.

The scan signal output part sequentially outputs the scan signals SCAN to the scan lines SL1 to SLn of the display panel 10. The initialization signal output part sequentially outputs initialization signals to the initialization lines IL1 to ILn. The emission signal output part sequentially outputs emission signals EM to the emission lines EML1 to EMLn of the display panel 10. Detailed descriptions of the scan signal SCAN, the initialization signal INI, and the emission signal EM are described in more detail in conjunction with FIG. 4.

The timing controller 40 receives digital video data RGB from the host system (not shown) through a low voltage differential signaling (LVDS) interface, a transition minimized differential signaling (TMDS) interface, etc. The timing controller 40 receives timing signals such as a vertical synchronization signal, a horizontal synchronization signal, a data enable signal, and a dot clock, and generates timing control signals for controlling operation timings of the data driver 20 and scan driver 30 based on the timing signals. The timing control signals include a scan timing control signal for controlling the operation timing of the scan driver 30 and a data timing control signal for controlling the operation timing of the data driver 20. The timing controller 40 outputs the scan timing control signal to the scan driver 30, and outputs the data timing control signal and the digital video data RGB to the data driver 20.

The power supply unit 50 supplies a first power voltage ELVDD to the pixels through first voltage supply lines ELVDDL, a second power voltage ELVSS to the pixels through the second voltage supply line ELVSSL. The first power voltage may be a high-potential voltage, and the second power voltage may be a low-potential voltage. The display panel 10 includes an initialization voltage line ViniL supplying an initialization voltage Vini according the first embodiment shown in FIG. 3. The display panel 10 does not need the initialization voltage line ViniL according the second embodiment shown in FIG. 10. Also, the power supply unit 50 supplies first and second logic level voltages V1, V2 to the scan driver 30.

By way of summation and review, embodiments of the present invention turn on a driving transistor DT and flow the drain-to-source current Ids of the driving transistor DT through the channel of the driving transistor by supplying an initialization voltage Vini to the gate electrode of the driving transistor DT and a data voltage Vdata to the first electrode of the driving transistor DT before the data voltage Vdata is supplied to the gate electrode of the driving transistor DT. As a result, embodiments of the present invention may prevent or reduce instances of the drain-to-source current of the driving transistor DT from increasing as steps (e.g., incrementally in subsequent frame periods) due to the hysteresis characteristics of the driving transistor in the case of displaying a white gray level image after displaying a black gray level image. Therefore, embodiments of the present invention may minimize or reduce the luminance difference between white gray level images caused by the hysteresis characteristics of the driving transistor in case of displaying a white gray level image after displaying a black gray level image, and relatively improve a picture quality.

Embodiments of the present invention may initialize a voltage of a first node N1 to the voltage between a data voltage and an initialization voltage during the initialization period. Also, embodiments of the present invention may apply a voltage change of an initialization line IL to the first node N1 by a cap boosting of a first capacitor C1 since the first capacitor C1 is coupled between the first node N1 and the initialization line IL. Therefore, embodiments of the present invention may decrease the voltage difference between the voltage between the data voltage Vdata and the initialization voltage Vini. Accordingly, embodiments of the present invention may charge the gate electrode of the driving transistor DT to a target voltage regardless of a data voltage supplied during a data voltage supply voltage. As a result, embodiments of the present invention may prevent or reduce the contrast ratio being lowered.

Embodiments may not need an initialization voltage line ViniL supplying an initialization voltage Vini if a gate electrode and a second electrode of the second transistor ST2 are coupled to an initialization line IL, and a first electrode thereof is coupled to a gate electrode of a driving transistor DT. Therefore, embodiments of the present invention may decrease a voltage input line formed on a display panel. As a result, embodiments of the present invention may have relatively more space for forming the pixel P.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims, and their equivalents.

What is claimed is:

1. An organic light emitting display device, comprising:

a display panel comprising data lines, scan lines, initialization lines, emission lines and a plurality of pixels, wherein a pixel of the pixels comprises:

a driving transistor comprising a gate electrode coupled to a first node, a first electrode coupled to a second node, and a second electrode coupled to a third node, the driving transistor configured to control an amount of a drain-to-source current of the driving transistor according to a voltage applied to the first node;

an organic light emitting diode configured to emit light depending on the drain-to-source current of the driving transistor;

a first transistor coupled between the second node and a data line of the data lines, the first transistor configured to be turned on by a scan signal applied to a scan line of the scan lines;

a second transistor configured to initialize the first node by being turned on;

a third transistor coupled between the first node and the third node, and the third transistor is configured to be turned on by the scan signal;

a fourth transistor coupled between the second node and a first voltage supply line that is configured to supply a first power voltage, wherein the fourth transistor is configured to be turned on by an emission signal of an emission line of the emission lines;

a fifth transistor coupled between the third node and the organic light emitting diode, wherein the fifth transistor is configured to be turned on by the emission signal; and a first capacitor coupled in parallel to the second transistor such that first and second electrodes of the first capacitor are coupled to first and second electrodes of the second transistor, respectively, wherein a gate electrode of the second transistor is coupled to an initialization line of the initialization lines that is configured to supply an initialization signal, wherein the first, second and third transistors are configured to be turned on during a first period, wherein the first and the third transistors are configured to be turned on and the second transistor is configured to be turned off during a second period subsequent to the first period, wherein a gate electrode of the first transistor is coupled to the scan line, a first electrode of the first transistor is coupled to the data line, a second electrode of the first transistor is coupled to the second node, wherein a gate electrode of the third transistor is coupled to the scan line, a first electrode of the third transistor is coupled to the third node, a second electrode of the third transistor is coupled to the first node, wherein a gate electrode of the fourth transistor is coupled to the emission line, a first electrode of the fourth transistor is coupled to the first voltage supply line, a second electrode of the fourth transistor is coupled to the second node, wherein a gate electrode of the fifth transistor is coupled to the emission line, a first electrode of the fifth transistor is coupled to the third node, a second electrode of the fifth transistor is coupled to an anode of the organic light emitting diode, wherein a cathode of the organic light emitting diode is coupled to a second voltage supply line that is configured to supply a second power voltage.

2. The organic light emitting display device of claim 1, wherein a first electrode of the second transistor is coupled to the first node.

3. The organic light emitting display device of claim 1, wherein the first electrode of the second transistor is coupled to the first node, and the second electrode of the second transistor is coupled to an initialization voltage line that is configured to supply an initialization voltage.

4. The organic light emitting display device of claim 1, wherein the fourth and fifth transistors are configured to be turned off during the first period and the second period.

5. The organic light emitting display device of claim 4, wherein the first to third transistors are configured to be turned off and the fourth and fifth transistors are configured to be turned on during a third period subsequent to the second period.

6. The organic light emitting display device of claim 5, wherein the scan signal and an initialization signal applied to an initialization line of the initialization lines are at a first logic level voltage and the emission signal is at a second logic level voltage during the first period.

7. The organic light emitting display device of claim 6, wherein the scan signal is at the first logic level voltage and the initialization signal and the emission signal are at the second logic level voltage during the second period.

8. The organic light emitting display device of claim 7, wherein the emission signal is at the first logic level voltage and the scan signal and the initialization signal are at the second logic level voltage during the third period.

9. The organic light emitting display device of claim 8, wherein each of the first to fifth transistors are configured to be turned on by the first logic level voltage and to be turned off by the second logic level voltage.

10. The organic light emitting display device of claim 1, wherein each of the first and second periods comprise several horizontal periods or dozens of horizontal periods.

11. The organic light emitting display device of claim 1, wherein the pixel further comprises a second capacitor coupled between the first node and a first voltage supply line that is configured to supply a first power voltage.

* * * * *